US005620139A

United States Patent [19]

Ziecker

[11] Patent Number: 5,620,139

[45] Date of Patent: Apr. 15, 1997

[54] NOZZLE ADAPTER WITH RECIRCULATION VALVE

[75] Inventor: Roger A. Ziecker, Lawrenceville, Ga.

[73] Assignee: Nordson Corporation, Westlake, Ohio

[21] Appl. No.: 503,806

[22] Filed: Jul. 18, 1995

[51] Int. Cl.[6] ..... B05B 7/06; B05B 7/10; B05B 9/00

[52] U.S. Cl. ..... 239/124; 239/406; 239/424.5

[58] Field of Search ..... 239/124, 125, 239/290, 296, 300, 301, 405, 406, 424.5, 537, 538, 581.1

[56] References Cited

U.S. PATENT DOCUMENTS 3,606,168 9/1971 Seaman, Jr. ..... 239/124 X 4,969,602 11/1990 Scholl ..... 239/406 X 4,983,109 1/1991 Miller et al. .

*Primary Examiner*—Andres Kashnikow

*Assistant Examiner*—Robin O. Evans

*Attorney, Agent, or Firm*—Wood, Herron & Evans, PLL

[57] ABSTRACT

A nozzle adapter for spraying liquid hot melt adhesive which includes a mounting plate, an adapter body fastened to the mounting plate and a nozzle unit received for rotation between the mounting plate and the adapter body. The nozzle unit may be rotated between a first position which is operative to dispense liquid and a second inoperative position which preferably redirects the liquid out of the adapter so that the liquid may be recirculated. The first position is also operative to discharge air against the liquid being dispensed to create, for example, a swirling bead pattern. In the second position, the air discharge of the nozzle unit is blocked.

18 Claims, 3 Drawing Sheets

4

NOZZLE ADAPTER WITH RECIRCULATION VALVE

BACKGROUND OF THE INVENTION

This invention generally relates to liquid dispensing and, more specifically, to a multinozzle dispensing apparatus including nozzle adapters which provide rapid and selective shut-off or recirculation capability to the apparatus.

Hot melt thermoplastic adhesives have been widely used in industry for adhering many types of products, and are particularly useful in applications where quick setting time is desired. One popular application for hot melt adhesives for several years has been in the manufacture of absorbent hygienic articles such as disposable diapers, incontinence pads and similar articles. Hot melt adhesive may be used, for example, to bond the backing sheet to the nonwoven fibrous material of the article and also to adhere the fluff layer to the nonwoven cover sheet.

One apparatus commonly used in the manufacture of disposable diapers and other hygienic articles is a metering gearhead having a plurality of spaced discharge orifices, each supplied with adhesive from a gear pump. The discharge orifices are positioned relative to the backing sheet of a diaper, for example, to apply parallel rows of adhesive thereto for subsequent attachment of the nonwoven absorbent pad of the diaper. A similar apparatus may be used to adhere the fluff layer to the nonwoven cover sheet. The primary advantages of metering gearheads include precise control of the quantity of adhesive dispensed and accurate location of the adhesive on the substrate so that the resulting product has multiple rows of adhesive of uniform adhesive volume, as well as uniform width and spacing of the rows. However, liquid dispensing apparatus such as metering gearheads which utilize a number of spray nozzles to dispense a relatively wide path of adhesive also have some areas in need of improvement.

One disadvantage of prior dispensing apparatus for hot melt adhesives concerns the relatively large amount of time which must be spent changing over or modifying an apparatus to dispense rows of adhesive along a wider or narrower path. This may be required, for example, in applications in which a single manufacturing line is used for manufacturing products of different sizes. An example of this is in the case of diapers, where the same manufacturing line may be used to manufacture or assemble several different sizes of diapers. The various metering gearheads used on the line must be modified to dispense adhesive along a path having a width corresponding to a particular size of diaper.

In the past, in order to modify the manufacturing line to accommodate a different substrate size, at least a portion of each metering gearhead had to be completely replaced with components having the correct number of outlet orifices or nozzles arranged at the proper width for the substrate, or one or more of the outside nozzles had to be removed and replaced by a blocking plate to change the effective dispensing width of that gearhead. U.S. Pat. No. 4,983,109, assigned to the assignee of the present invention, and the disclosure of which is hereby fully incorporated by reference herein, discloses various types of such blocking plates which may be used to recirculate the adhesive into the conventional recirculation loop of the gearhead so that there are no dead-end passages created which might lead to charring.

Both of these prior changeover methods not only require undesirable amounts of down time for the production line, but also require the stocking of additional parts which may add to the expense and inconvenience of the changeover process. Furthermore, the areas of the production line in which such metering gearheads are typically mounted generally do not allow easy access to the nozzles with the tools required for changing from nozzles to backing plates and vice versa or to change the necessary gearhead components.

It would therefore be desirable to provide nozzles and a dispensing apparatus including one or more such nozzles which may be easily changed over from an operative dispensing condition to a recirculating condition without the need for tools and without the need for replacement parts such as blocking plates.

SUMMARY OF THE INVENTION

It has therefore been one object of this invention to provide faster changeover times for liquid dispensing apparatus utilizing a plurality of spray nozzles when changing a production line from one size substrate to another.

It has been another object of this invention to effect such changeover easily even in the cramped environment of a crowded production line.

It has been yet another more specific object of this invention to provide a nozzle adapter having a nozzle unit which is easily moved between an operative state and an inoperative, recirculating state by an easily accessible handle.

To these ends, the present invention provides a nozzle adapter for spraying liquid, such as hot melt adhesive, with the nozzle adapter generally including a mounting member and a nozzle unit secured to the mounting member for relative movement between at least first and second positions. The mounting member includes an adhesive input passage and an air input passage which align with respective adhesive and air passages of the nozzle unit in the first position to allow the nozzle unit to dispense adhesive in a known pattern, such as a swirling pattern. In the second position, a recirculation connecting passage in the nozzle unit connects the adhesive input passage of the mounting member to an adhesive recirculation passage in the mounting member. The recirculation connecting passage is preferably an elongate slot or groove in a face of the nozzle unit which rotates against an opposed face of the mounting member to which the adhesive input passage and adhesive recirculation passage each open. With the nozzle adapter unit attached to a nozzle manifold, the adhesive recirculation passage aligns with a port in the manifold leading to a conventional recirculation loop. In the second position, the air passage of the nozzle unit is also preferably blocked to shut off the flow of air to the nozzle unit.

More specifically, the nozzle unit may include a conventionally designed nozzle tip at one end and a cylindrical body portion at the other end which is captured between an adapter body and the mounting member in a manner allowing rotational movement of the nozzle unit between the first and second positions. The adapter body is preferably fastened to the mounting member, which may be a mounting plate, and the entire nozzle adapter assembly is attachable to a metering gearhead, for example, by separate fasteners such that the entire assembly may be removed for cleaning and maintenance as necessary.

The nozzle unit preferably includes a handle extending outwardly from both the nozzle unit and from a slot contained in the adapter body such that the nozzle unit may be easily rotated between the first and second positions even when space in the vicinity of the dispensing apparatus is limited. As mentioned above, the preferred configuration of the nozzle tip is one conventional design which emits a swirling pattern of liquid adhesive. Other types of nozzles may also be used, depending on the requirements of the application. Finally, the mounting member or plate includes a groove in one side thereof facing the nozzle unit and separating the various adhesive passages from the air passages. The purpose of this groove is to receive and bleed off any adhesive which backs up within the nozzle adapter and prevent such adhesive from entering the air passages.

These and other objects and advantages of the present invention will become more readily apparent to those of ordinary skill in the art upon review of the following detailed description of one preferred embodiment taken in conjunction with the accompanying drawings.

DETAILED DESCRIPTION OF THE PREFERRED EMBODIMENT

Figure 1:
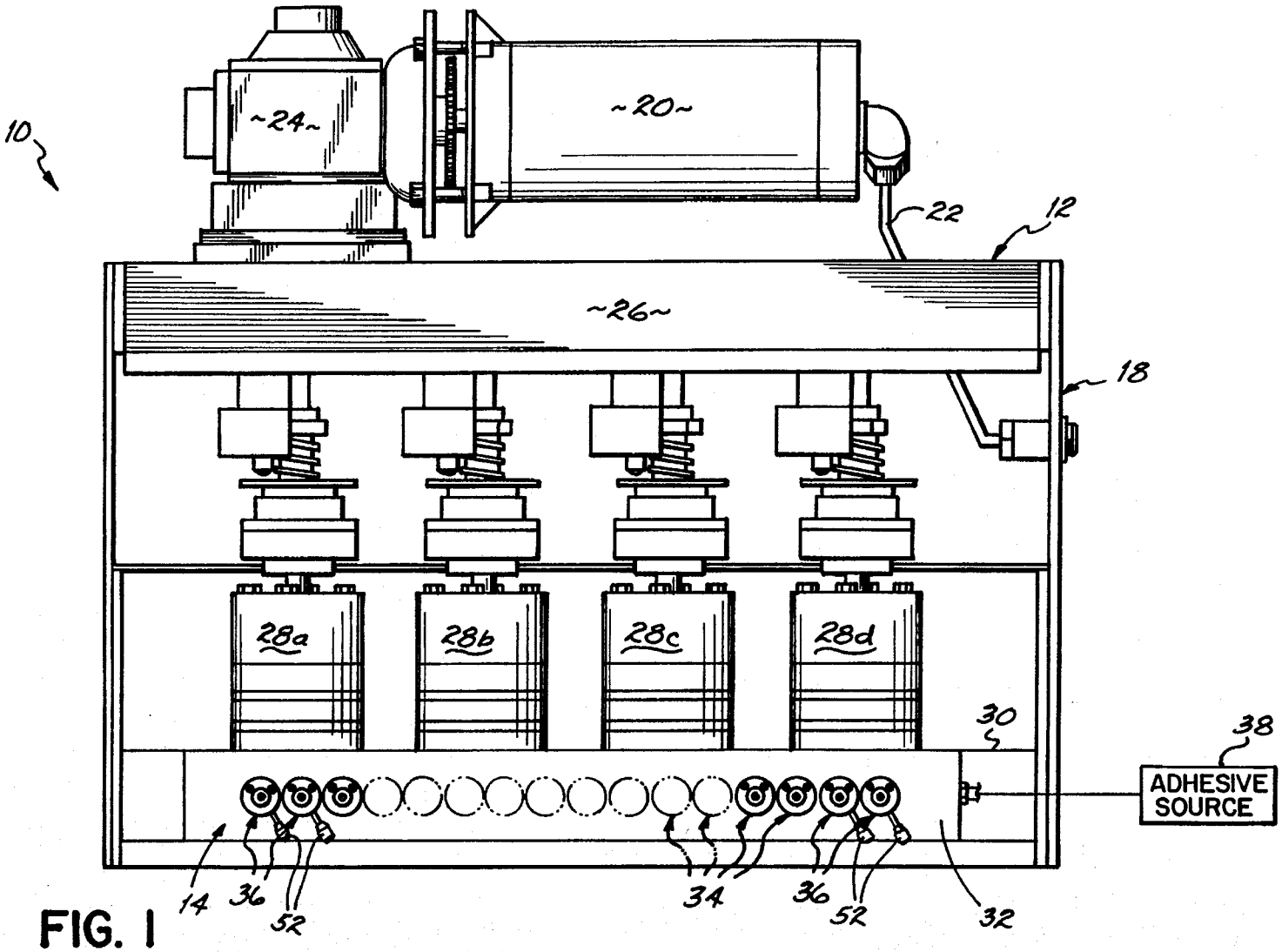
FIG. 1 is a bottom view of a metering gearhead with a plurality of spray nozzles including nozzle adapter assemblies constructed in accordance with a preferred embodiment of this invention.

Referring first to FIG. 1, a hot melt adhesive dispensing system 10 is illustrated which comprises a flow metering device such as a metering gearhead 12 and a spray head attachment 14 mounted to the metering gearhead 12. The dispensing system 10 is operable to discharge a plurality of rows of hot melt adhesive, preferably in the form of elongated strands or fibers, onto the surface of a moving substrate (not shown), such as a backing sheet used in the formation of hygienic articles including disposable diapers.

Metering gearhead 12 may be of a commercially available type, such as the type disclosed in U.S. Pat. No. 4,983,109 referred to and incorporated hereinabove. The structural details of metering gearhead 12 form no part of this invention per se and thus only the general construction of metering gearhead 12 is illustrated and discussed herein. Other multiple nozzle dispensing devices may also be utilized with the present invention. Metering gearhead 12 comprises a housing 18 having a top surface which mounts an electric motor 20 connected to an electric cable 22, and a gear reducer 24 which is drivingly connected to the output of motor 20. The output of gear reducer 24 is connected to a transmission 26 which extends across the top of housing 18 between its opposed sides. Transmission 26 is drivingly connected to four gear pumps 28*a*, 28*b*, 28*c*, 28*d* which are located in the interior of housing 18.

Gear pumps 28*a*–*d* are mounted to a manifold 30 carried at the base of housing 18. Spray head attachment 14 comprises a manifold 32 attached to manifold 30 and including a plurality of spray nozzles 34, at least some of which are constructed as nozzle adapter assemblies 36 in accordance with the preferred embodiment of this invention. Spray nozzle manifold 32 receives liquid hot melt adhesive from an adhesive source 38 and adhesive is dispensed from nozzles 34, 36 in a conventional pattern, such as the swirling pattern disclosed in U.S. Pat. No. 4,983,109 mentioned above.

Figure 2:
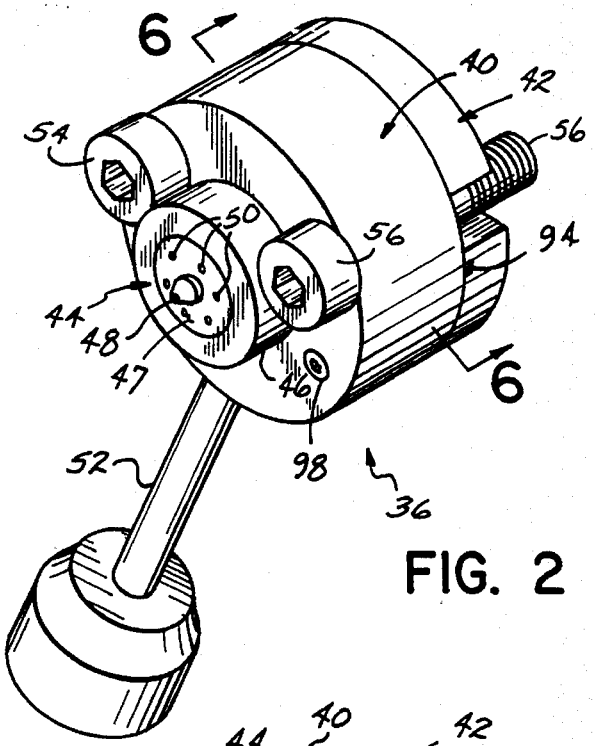
FIG. 2 is a perspective view of a single nozzle adapter assembly of the present invention.

Referring now to FIG. 2, each nozzle adapter assembly generally includes an adapter body 40 fastened to a mounting plate 42 and holding a nozzle unit 44 against mounting plate 42 for rotation between at least two positions which will be discussed further below. Adapter body 40 includes a projecting portion 46 which receives a nozzle tip portion 47. Tip portion 47 of nozzle unit 44 includes a central adhesive discharge outlet 48 and a plurality of air discharge outlets 50 surrounding adhesive outlet 48 to cause the preferred swirling pattern of adhesive.

Figure 3:
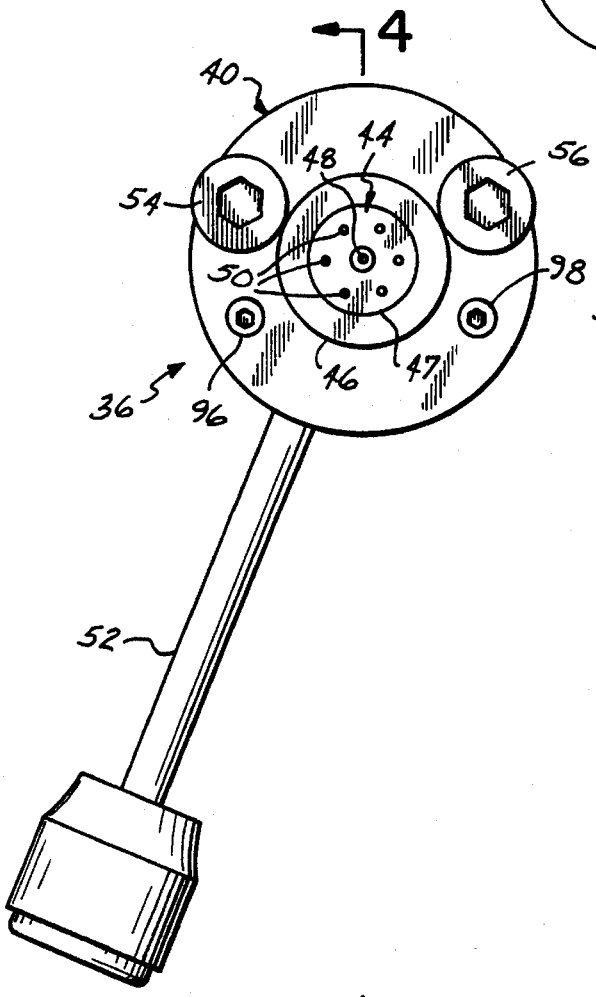
FIG. 3 is a bottom view of the nozzle adapter assembly shown in FIG. 2.
Figure 4:
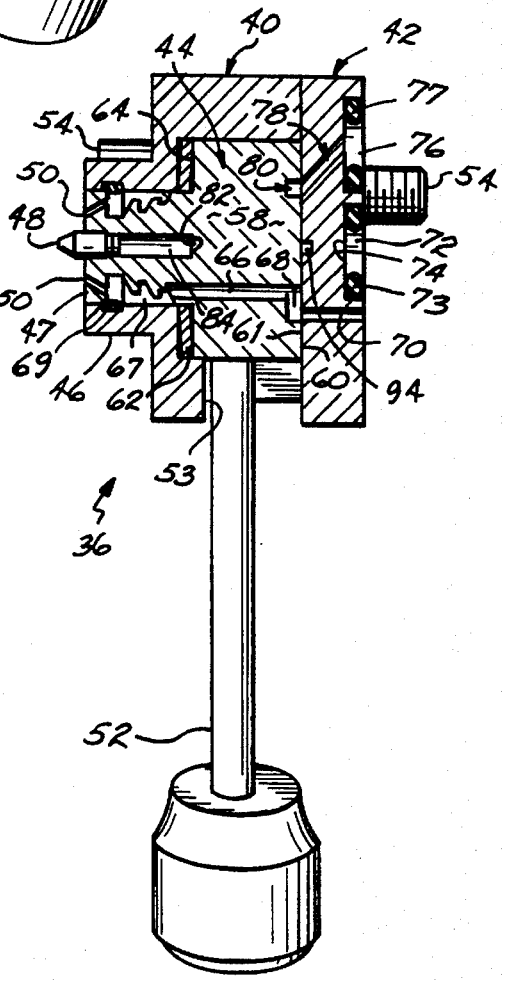
FIG. 4 is a cross-sectional view of the nozzle adapter assembly taken along line 4—4 of FIG. 3.

Referring to FIGS. 2–4, nozzle adapter assembly 36 further includes a handle 52 ,which is rigidly attached to nozzle unit 44 for rotating nozzle unit 44 between an operative position and an inoperative, recirculation position as will be discussed below. Handle 52 extends outwardly from a slot 53, the length of which defines the limits of movement for handle 52 and nozzle unit 44. Socket head cap screws 54, 56 are provided through adapter body 40 and mounting plate 42 to mount nozzle adapter assembly 36 to spray nozzle manifold 32 (FIG. 1). As best shown in FIG. 4, nozzle unit 44 includes a cylindrical portion 58 which is received for rotation within adapter body 40 and against mounting plate 42. Specifically, one face 60 of cylindrical portion 58 rotates against a face 61 of mounting plate 42. A spring washer 62 bears against the opposite face 64 of cylindrical portion 44 to maintain faces 60, 61 in constant contact with each other.

Figure 5:
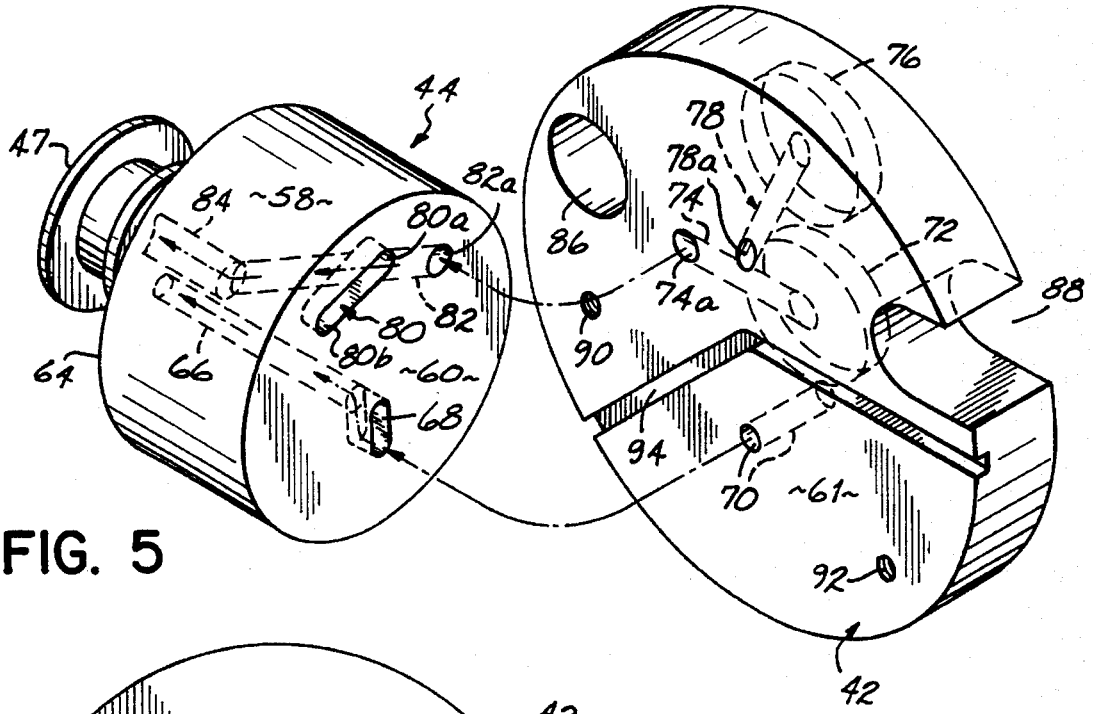
FIG. 5 is a an exploded perspective view of the nozzle unit and mounting plate which form part of the nozzle adapter assembly of this invention.

As best illustrated in FIGS. 4 and 5, various passages and slots for adhesive and air are provided in mounting plate 42 and nozzle unit 44 in accordance with this invention. Specifically, an air passage 66 is provided through cylindrical portion 58 of nozzle unit 44 and communicates at one end with a space 67 (FIG. 4) located between projecting adapter body portion 46 and nozzle tip portion 47 and at the other end with a slot 68 in face 60 of cylindrical portion 58. In the first position of handle 52, and as will be further appreciated from the description below, slot 68 communicates with an air input passage 70 contained in mounting plate 42. Air input passage 70 aligns with a pressurized air port (not shown) in manifold 32 when mounted as shown in FIG. 1, Mounting plate 42 includes a first circular recess 72 containing an O-ring 73 which surrounds a central adhesive input port or passage 74 extending through mounting plate 42 as shown in FIG. 5. A second circular recess 76 is also provided in mounting plate 42 and also contains an O-ring 77 surrounding a recirculation passage 78 which, in the first or operative position, aligns with one end 80*a* of an elongate recess or slot 80 contained in face 60 of nozzle unit 44 as best shown in FIG. 5. As further shown in FIG. 5, nozzle unit 44 includes communicating adhesive passages 82, 84 with passage 84 leading to adhesive discharge outlet 48 (FIG. 4). Passage 82 aligns with passage 74 in the operative position shown in FIGS. 4–6 to dispense adhesive as will be discussed below.

Still referring to FIG. 5, mounting plate 42 further includes a hole 86 and a slot 88 for receiving the respective socket head cap screws 54, 56 used to fasten nozzle adapter assembly 36 to manifold 32 (FIG. 1). A pair of holes 90, 92 are also provided for receiving a countersunk flat headed screw fasteners, 96, 98 (FIG. 3) which fasten mounting plate 42 to adapter body 40 with nozzle unit 44 held for rotation therebetween. In this way, when socket head cap screws 54, 56 are removed, nozzle adapter assembly 36 will remain together as a unit for easier removal from manifold 32 (FIG. 1). FIG. 5 shows nozzle unit 44 and mounting plate 42 exploded from the first position of nozzle unit 44 in which adhesive input passage 74 of mounting plate 42 is aligned with adhesive passage 82 of nozzle unit 44. In this first position, air input passage 70 of mounting plate 42 is aligned with slot 68 of nozzle unit 44. Thus, in this operative position, adhesive is supplied from input passage 74 through passages 82 and 84 and finally through discharge outlet 48 (FIG. 4). Also, pressurized air is supplied through passage 70, slot 68 and passage 66. As shown in FIG. 4, the air is then directed into space 67, past O-ring 69 and through air discharge outlets 50 in nozzle tip 47 to create a swirling pattern of liquid adhesive from outlet 48. O-ring 69 forms a seal between projecting portion 46 of adapter body 40 and nozzle tip 47.

Figure 6:
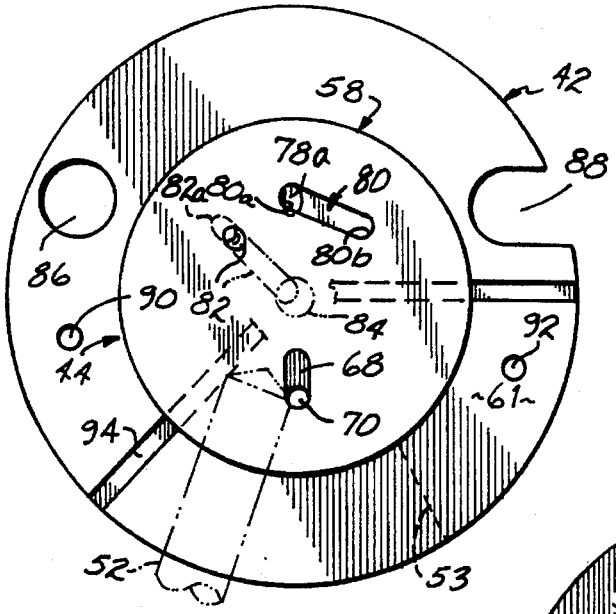
FIG. 6 is a cross-sectional view taken along line 6—6 of FIG. 2 and showing the nozzle unit in a first, operative position.
Figure 7:
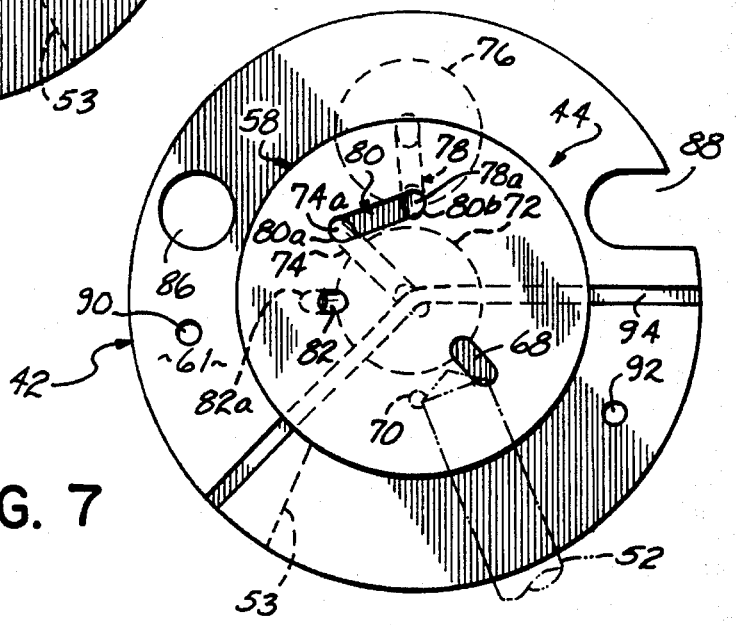
FIG. 7 is a cross-sectional view similar to FIG. 6 but showing the nozzle unit in a second, inoperative position for recirculating the liquid adhesive back into the metering gearhead apparatus and shutting of the supply of pressurized air to the nozzle unit.

The alignment and configuration of the various slots and passages within mounting plate 42 and nozzle unit 44 in going from the first, operative position of nozzle unit 44 to the second, inoperative or recirculation position will be best understood by an examination of FIGS. 5 and 6 (which show the operative nozzle unit position) taken in conjunction with FIG. 7 which shows the inoperative or recirculation position. With handle 52 and nozzle unit 44 in the first position shown in FIG. 6, opening 82*a* of adhesive passage 82 aligns with opening 74*a* of adhesive input passage 74 as best appreciated from FIG. 5. Also, as discussed above, air input passage 70 communicates with slot 68 to provide pressurized air to nozzle tip 47. When handle 52 and nozzle unit 44 are rotated to the second position shown in FIG. 7, slot 80 in nozzle unit 44 rotates to align itself between opening 74*a* of adhesive input passage 74 and opening 78*a* of adhesive recirculation passage 78. That is, slot end 80*a* aligns with input adhesive passage opening 74*a* and slot end 80*b* aligns with recirculation passage opening 78*a*. At the same time, opening 82*a* of adhesive passage 82 in nozzle unit 44 slides against face 61 of mounting plate 42 and is blocked from receiving any adhesive. It will therefore be appreciated that adhesive flowing into adhesive input passage 74 travels from passage 74 through opening 74*a* into slot 80 and back out through adhesive recirculation passage 78 into the conventional recirculation loop of metering gearhead 12 (FIG. 1). Also, as illustrated in FIG. 7, slot 68 rotates to the position shown out of communication with air input passage 70 and therefore pressurized air is prevented from entering passage 66.

In each position of nozzle unit 44, bleed-off passage or groove 94 will prevent any adhesive from reaching air passages 66, 68 or 70 in the event that adhesive backs up between mounting plate 42 and nozzle unit 44. This is because air passages 66, 68, 70 are separated from adhesive passages 74, 78, 80, 82 by groove 94 in each position of nozzle unit 44.

From the foregoing description, it will readily be appreciated from a review of FIG. 1 that when it is desired to change the width of the path of adhesive dispensed by metering gearhead 12, all that is necessary to effect this changeover is to move the handles 52 of one or more of the outermost nozzle adapter assemblies 36 to shut off these nozzles and recirculate the adhesive which is sent to them. Thus, for example, when a production line is being changed over from a larger or wider diaper to a smaller or narrower diaper, the outer nozzle adapter assemblies on opposite ends of manifold 32 may be shut off by moving their handles 52 from the first position to the second position described above. No tools are required for this changeover procedure and it may be accomplished very quickly even in an environment with little working space. When it is desired to again change from the narrower path of adhesive to a wider path, the necessary number of outer handles 52 may be moved back to the first, operative position. It will be appreciated that several nozzle adapter assemblies 36 may be utilized to allow a wide range of adhesive path widths or configurations depending on which nozzle adapter assemblies are in the operative position and which are in the recirculation position.

Although a detailed description of one preferred embodiment of this invention has been given above, it will readily appreciated that many modifications and substitutions may be made to this embodiment without departing from the spirit and scope of the invention. Therefore, it is not Applicant's intent to be bound by the details provided herein, but only by the claims appended hereto.

What is claimed is:

1. A nozzle adapter for spraying liquid hot melt adhesive, the nozzle adapter comprising:

a mounting member having an adhesive input passage, a recirculation outlet passage, and an air input passage;

a nozzle unit secured to said mounting member for relative movement with respect thereto between at least first and second positions, said nozzle unit including an adhesive passage leading to an adhesive discharge outlet, a recirculation connecting passage and an air passage leading to an air discharge outlet; and, wherein in the first position the adhesive passage of said nozzle unit aligns with the adhesive input passage of said mounting member and the air passage of said nozzle unit aligns with the air input passage of said mounting member to dispense adhesive and air from the respective adhesive and air discharge outlets, and in the second position the recirculation connecting passage of said nozzle unit connects the adhesive input passage with the adhesive recirculation outlet passage of said mounting member and the air passage of said nozzle unit is blocked to shut off the flow of air to said air discharge outlet.

2. The nozzle adapter of claim 1 wherein said nozzle unit is secured for rotational movement with respect to said mounting member.

3. The nozzle adapter of claim 2 wherein said nozzle unit includes a handle for moving said nozzle unit from said first position to said second position.

4. The nozzle adapter of claim 1 further comprising at least one fastener extending from said mounting member for fastening the nozzle adapter to a multinozzle dispensing apparatus.

5. The nozzle adapter of claim 4 further comprising at least a second fastener for attaching said nozzle unit and said mounting member together when said nozzle adapter is detached from said multinozzle dispensing apparatus.

6. The nozzle adapter of claim 1 wherein said nozzle unit emits a swirling pattern of liquid adhesive.

7. The nozzle adapter of claim 1 further comprising a bleed off passage separating said air input passage and said adhesive input passage of said mounting member.

8. The nozzle adapter of claim 1 further comprising an adapter body which receives a cylindrical portion of said nozzle unit for rotation between said first and second positions.

9. The nozzle adapter of claim 1 wherein said recirculation connecting passage is an elongate groove in a face of said nozzle unit which rotates against an opposed face of said mounting member.

10. A nozzle adapter for spraying liquid hot melt adhesive, the nozzle adapter comprising:

a mounting plate having an adhesive input passage, a recirculation outlet passage, and an air input passage;

an adapter body fastened to said mounting plate;

a nozzle unit secured between said mounting plate and said adapter body for relative movement with respect to said mounting plate between at least first and second positions, said nozzle unit including an adhesive passage leading to an adhesive discharge outlet, a recirculation connecting passage and an air passage leading to an air discharge outlet; and, wherein in the first position the adhesive passage of said nozzle unit aligns with the adhesive input passage of said mounting plate and the air passage of said nozzle unit aligns with the air input passage of said mounting plate to dispense adhesive and air from the respective adhesive and air discharge outlets, and in the second position the recirculation connecting passage of said nozzle unit the adhesive input passage with the adhesive recirculation outlet passage of said mounting plate and the air passage of said nozzle unit is blocked to shut off the flow of air to said air discharge outlet.

11. The nozzle adapter of claim 10 wherein said nozzle unit is secured for rotational movement between said mounting plate and said adapter body.

12. The nozzle adapter of claim 10 wherein said nozzle unit includes a handle extending outwardly from a slot in said adapter body.

13. The nozzle adapter of claim 12 wherein said mounting plate and said adapter body are fastened together with the nozzle unit held for rotational movement therebetween.

14. The nozzle adapter of claim 13 further comprising at least one fastener extending from said mounting plate for fastening the nozzle adapter to a multinozzle dispensing apparatus.

15. The nozzle adapter of claim 14 further at least a second fastener for attaching said nozzle unit and said mounting plate together when said nozzle adapter is detached from said multinozzle dispensing apparatus.

16. The nozzle adapter of claim 10 wherein said nozzle unit emits a swirling pattern of liquid adhesive.

17. The nozzle adapter of claim 10 further comprising a bleed off passage separating said air input passage and said adhesive input passage of said mounting plate.

18. The nozzle adapter of claim 10 wherein said recirculation connecting passage is an elongate groove in a face of said nozzle unit which rotates against an opposed face of said mounting member.

* * * * *